US010908629B2

(12) United States Patent
Peng et al.

(10) Patent No.: US 10,908,629 B2
(45) **Date of Patent: *Feb. 2, 2021**

(54) SHIFTER LEVER STRUCTURE AND REMOTE CONTROLLER USING THE SAME

(71) Applicant: SZ DJI TECHNOLOGY CO., LTD., Shenzhen (CN)

(72) Inventors: Tao Peng, Shenzhen (CN); Yin Tang, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 35 days.

This patent is subject to a terminal disclaimer.

(21) Appl. No.: 16/291,153

(22) Filed: Mar. 4, 2019

(65) Prior Publication Data

US 2019/0196529 A1 Jun. 27, 2019

Related U.S. Application Data

(63) Continuation of application No. 15/611,173, filed on Jun. 1, 2017, now Pat. No. 10,222,820, which is a (Continued)

(51) Int. Cl.
*G05G 1/10* (2006.01)
*G05G 1/01* (2008.04)
(Continued)

(52) U.S. Cl.
CPC ..... *G05G 1/01* (2013.01); *G05G 5/02* (2013.01); *G05G 5/05* (2013.01); *G05G 9/047* (2013.01);
(Continued)

(58) Field of Classification Search
CPC .. G05G 1/01; G05G 5/02; G05G 5/05; G05G 9/047; G05G 2009/04748;
(Continued)

(56) References Cited

U.S. PATENT DOCUMENTS 5,187,630 A 2/1993 MacKay et al.
5,229,742 A 7/1993 Miyamoto et al.
(Continued)

FOREIGN PATENT DOCUMENTS

CN 1715491 A 1/2006
CN 201107681 Y 8/2008
(Continued)

OTHER PUBLICATIONS

The World Intellectual Property Organization (WIPO) International Search Report for PCT/CN2014/092732 dated Jul. 10, 2015 7 Pages.

*Primary Examiner* — Richard W Ridley
*Assistant Examiner* — Brian J McGovern
(74) *Attorney, Agent, or Firm* — Anova Law Group, PLLC

(57) ABSTRACT

A remote controller comprising a shifter lever structure, a controller, and a signal emission device electrically coupled to the controller. The shifter lever structure includes a base, a press key movably connected to the base, a shifter lever arranged surrounding the press key and movably connected to the base, and a sensor coupled to the press key and the shifter lever. The sensor is configured to obtain moving state information about the press key and the shifter lever. The sensor includes at least one of an angle sensor, an angular displacement sensor, an angular velocity sensor, an angular acceleration sensor, a torque sensor, a distance sensor, a linear displacement sensor, a linear velocity sensor, a linear acceleration sensor, or a pressure sensor. The controller is configured to receive the moving state information from the sensor and emit a control signal corresponding to the information via the signal emission device.

20 Claims, 8 Drawing Sheets

Related U.S. Application Data continuation of application No. PCT/CN2014/092732, filed on Dec. 2, 2014.

(51) Int. Cl.

| | |
|---|---|
| ***G05G 9/047*** | (2006.01) |
| ***G05G 5/02*** | (2006.01) |
| ***G05G 5/05*** | (2006.01) |
| *G08C 17/02* | (2006.01) |

(52) U.S. Cl.

CPC ..... *G05G 9/04792* (2013.01); *G05G 9/04796* (2013.01); *G05G 1/105* (2013.01); *G05G 2009/04748* (2013.01); *G05G 2009/04751* (2013.01); *G05G 2009/04766* (2013.01); *G05G 2009/04774* (2013.01); *G08C 17/02* (2013.01)

(58) Field of Classification Search

CPC ..... G05G 2009/04751; G05G 2009/04766; G05G 2009/04774; G05G 1/04; G05G 1/08; G05G 1/00; G05G 1/10; G08C 17/02; H01H 9/00; D06F 37/00; G11B 33/00; H01C 10/16; H01C 10/00

USPC ..... 74/503, 504, 511 R, 519, 523

See application file for complete search history.

(56) References Cited

U.S. PATENT DOCUMENTS

| | | | | |
|---|---|---|---|---|
| 5,665,946 | A | 9/1997 | Nishijima et al. | |
| 10,222,820 | B2 * | 3/2019 | Peng | G05G 1/01 |
| 2009/0008233 | A1 | 1/2009 | Saomoto | |
| 2009/0084214 | A1 | 4/2009 | Sakai et al. | |

FOREIGN PATENT DOCUMENTS

| | | | |
|---|---|---|---|
| CN | 102955478 | A | 3/2013 |
| CN | 202838082 | U | 3/2013 |
| CN | 103721422 | A | 4/2014 |
| DE | 10042028 | A1 | 3/2002 |
| WO | 2014187027 | A1 | 11/2014 |

* cited by examiner

SHIFTER LEVER STRUCTURE AND REMOTE CONTROLLER USING THE SAME

CROSS-REFERENCE TO RELATED APPLICATION

This is a continuation application of U.S. application Ser. No. 15/611,173, filed on Jun. 1, 2017, which is a continuation application of International Application No. PCT/CN2014/092732, filed on Dec. 2, 2014, the entire contents of both of which are incorporated herein by reference.

TECHNICAL FIELD

The present disclosure generally relates to press key structures, and particularly to shifter lever structures and remote controllers using the same.

BACKGROUND

A shifter lever structure is a common operating structure for a handheld operating control device, such as a remote controller of a single-lens reflex camera or an unmanned aerial vehicle. Working parameters of the aerial vehicles or the cameras can be quickly adjusted by operating the shifter lever of the shifter lever structure with a finger.

In the above-mentioned common control method for the remote controller of a single lens reflex camera or an unmanned aerial vehicle, conventional shifter lever structures usually only provides a single operating function which is not combined with other operating functions. However, for the above-mentioned device, since fingers have a limited moving range, an operator usually needs to complete an operating function via the cooperation of a plurality of shifter lever structures or with other control structures, or alternatively, a plurality of operating functions respectively require different shifter lever structures, thus the control thereof is relatively inconvenient.

SUMMARY

In view of this, the present disclosure provides a shifter lever structure with relatively convenient control.

In accordance with the disclosure, there is provided a remote controller comprising a shifter lever structure, a controller, and a signal emission device. The shifter lever structure comprises a base, a press key movably connected to the base, a shifter lever arranged surrounding the press key and movably connected to the base, and a sensor coupled to the press key and the shifter lever and configured to obtain moving state information about the press key and the shifter lever. A movement mode of the shifter lever is different from a movement mode of the press key. The controller is electrically coupled to the sensor. The signal emission device is electrically coupled to the controller. The controller is configured to receive the moving state information from the sensor and emit a control signal corresponding to the moving state information via the signal emission device.

In some embodiments, the press key is configured to slide relative to the base and/or the shifter lever is configured to rotate around the press key.

In some embodiments, a sliding direction of the press key approximately coincides with a lengthwise direction of the shifter lever.

In some embodiments, the press key comprises a connecting rod inserted in the base and configured to slide in the base along a lengthwise direction of the connecting rod.

In some embodiments, the connecting rod passes through the shifter lever and is configured to slide relative to the shifter lever, and the shifter lever is configured to rotate around the connecting rod.

In some embodiments, the press key further comprises a button arranged at one end of the connecting rod.

In some embodiments, the shifter lever comprises a rotating part and a shifting part connected to the rotating part, and the shifting part is configured to drive the rotating part to rotate around the connecting rod.

In some embodiments, a top surface of the rotating part includes an accommodating groove for accommodating the button, the button is configured to slide in the accommodating groove, and the connecting rod passes through a bottom part of the accommodating groove.

In some embodiments, the shifter lever further comprises a rotary barrel, a first end of the rotary barrel being an opening end fixedly connected to the rotating part, and a second end of the rotary barrel including a through hole for the connecting rod to pass through.

In some embodiments, the shifter lever structure further comprises a rotation trigger fixedly connected to the second end of the rotary barrel and arranged corresponding to the sensor, and the sensor is further configured to obtain a rotating state information about the shifter lever by sensing a rotating state of the rotation trigger.

In some embodiments, the rotation trigger includes a bush mating with the rotary barrel, and the second end of the rotary barrel is fixed in the bush and is configured to drive the bush to rotate.

In some embodiments, the shifter lever structure further comprises a rotation damping mechanism for providing damping during rotation of the shifter lever structure.

In some embodiments, the rotation damping mechanism comprises a plurality of limiting parts arranged on the base and being spaced apart from each other, an elastic reset member accommodated in an accommodating groove in the rotation trigger, and a roller ball accommodated in the accommodating groove in the rotation trigger and abutting against the elastic reset member. The roller ball is configured to selectively fit with one of the limiting parts to provide a rotation resistance.

In some embodiments, the rotation damping mechanism comprises a plurality of limiting parts spaced apart from each other and arranged on one of the base and the rotation trigger and an elastic snapping strip arranged on another one of the base and the rotation trigger and configured to selectively abut against one of the limiting parts to provide the rotation resistance.

In some embodiments, the shifter lever structure further comprises a circuit board for carrying the sensor and the base comprises a mounting barrel for accommodating the rotation trigger and the sensor. The mounting barrel is fixedly connected to the circuit board to form a sealed cavity.

In some embodiments, an end face at an end of the mounting barrel far away from the circuit board includes an accommodating part. A bottom part of the accommodating part includes a penetration hole in communication with an inner cavity of the mounting barrel. The rotating part is rotatably accommodated in the accommodating part and the rotary barrel passes through the penetration hole.

In some embodiments, the shifter lever structure further comprises a locking member. An end of the connecting rod far away from the button is connected to the locking member to prevent the connecting rod from falling off the rotation trigger.

In some embodiments, the shifter lever structure further comprises a sliding reset member providing an elastic restoring force to the connecting rod.

In some embodiments, the sensor comprises at least one of an angle sensor, an angular displacement sensor, an angular velocity sensor, an angular acceleration sensor, a torque sensor, a distance sensor, a linear displacement sensor, a linear velocity sensor, a linear acceleration sensor, or a pressure sensor.

In some embodiments, the shifter lever is configured to automatically return to an original position or remain at a current rotation position when the shifter lever is released after rotation.

In some embodiments, the press key is configured to automatically reset to an original position or remain at a current sliding position when the press key is released after sliding.

In one embodiment, the base comprises a light guiding part surrounding the periphery of the shifter lever.

In some embodiments, further comprised is a light-emitting element arranged corresponding to the light guiding part, and the light-emitting element shows an indicative message via light colours and/or light-emitting states.

In some embodiments, the indicative message is used for indicating at least one of: the operating state of the press key, the operating state of the shifter lever, and the state of an object under remote control.

A shifter lever of the above-mentioned shifter lever structure, which comprises the press key and is arranged surrounding the press key, facilitates operating the press key or the shifter lever selectively, for example, the shifter lever can rotate around a rotating shaft or the press key slides along a pre-set direction, and so on. By obtaining the rotating state information about the shifter lever and the sliding state information about the press key via the sensor, the above structure facilitates operating the shifter lever structure via one moving mode or a combination of multiple operating modes, so as to achieve the purpose of performing multiple operating functions, without the need to arrange a plurality of shifter lever structures or other control structures. Therefore, it is more convenient to control the multiple functions via the above-mentioned shifter lever structure than conventional technologies.

DETAILED DESCRIPTION OF THE EMBODIMENTS

Figure 1:
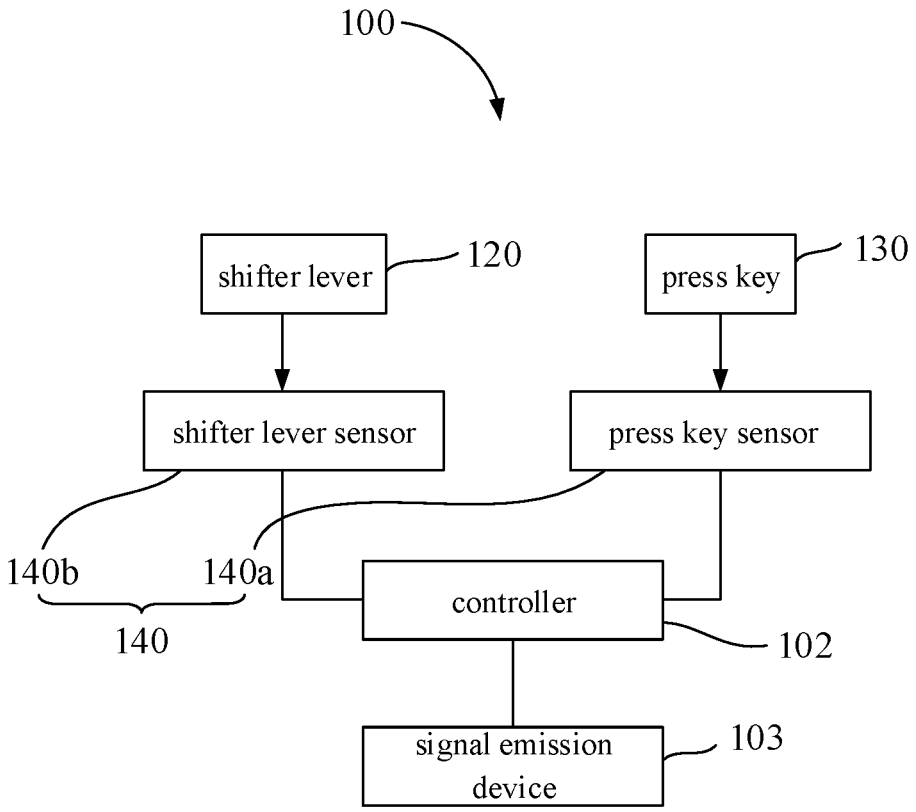
FIG. 1 is a principle diagram of a remote controller in one embodiment of the present disclosure.

The technical solutions of the present disclosure are hereinafter described in more detail with reference to the accompanying drawings. The described embodiments are only some rather than all of the embodiments of the present disclosure. All other embodiments obtained by a person of ordinary skill in the art based on the described embodiments without creative efforts shall fall within the scope of the present disclosure.

It shall be explained that, when a component is described as "fixed to" another component, it can be directly on another component, or an intermediate component can be present. When a component is described as "connected" to another component, it can be directly connected to another component, or an intermediate component can be present at the same time. The terms "vertical", "horizontal", "left", "right" and similar expressions used herein are intended for the purposes of illustration only.

Unless otherwise defined, all technical and scientific terms used herein have the same meaning as commonly understood by one of ordinary skill in the art to which this disclosure belongs. The terms used in the description of the present disclosure are for the purpose of describing particular embodiments and are not intended to limit the present disclosure. The term "and/or" used herein includes any and all combinations of one or more of the associated listed items.

One embodiment of the present disclosure provides a shifter lever structure, comprising a base, a shifter lever, a press key and a sensor. The press key is movably connected to the base. The shifter lever is arranged surrounding the press key, and is movably connected to the base. The sensor is used for obtaining the moving state information about the press key and the shifter lever.

The movement modes of the press key and the shifter lever can be designed according to different requirements, for example, in some embodiments, the press key can slide relative to the base, and the shifter lever is rotatably connected to the base and can rotate around the press key.

In some embodiments, the shifter lever structure further comprises a light guiding part arranged surrounding the shifter lever. The light guiding part can be integrated with the base, or arranged separately.

In some embodiments, the shifter lever structure further comprises a light-emitting element arranged corresponding to the light guiding part.

Based on the above-mentioned shifter lever structure, one embodiment of the present disclosure further provides a remote controller.

The remote controller comprises a shifter lever structure as described above, a controller, and a signal emission device. The controller is electrically connected to the sensor. The signal emission device is electrically connected to the controller. The sensor transmits the moving state information to the controller, and the controller emits a corresponding control signal via the signal emission device.

Based on the above-mentioned remote controller, one embodiment of the present disclosure further provides a control method. The control method controls a remote control device by operating a shifter lever structure as described above, for example, it may control a mobile device, an imaging device, a gimbal platform, a sensor, a base, and so on.

It shall be explained that, the above-mentioned shifter lever structure is not limited to being applied to a remote controller, and can also be applied to other devices such as a mobile phone, a tablet, etc.

Some embodiments of the present disclosure will be described in detail below in conjunction with the accompanying drawings. The embodiments below and the features in the embodiments may be combined with each other if there is no conflict.

Figure 2:
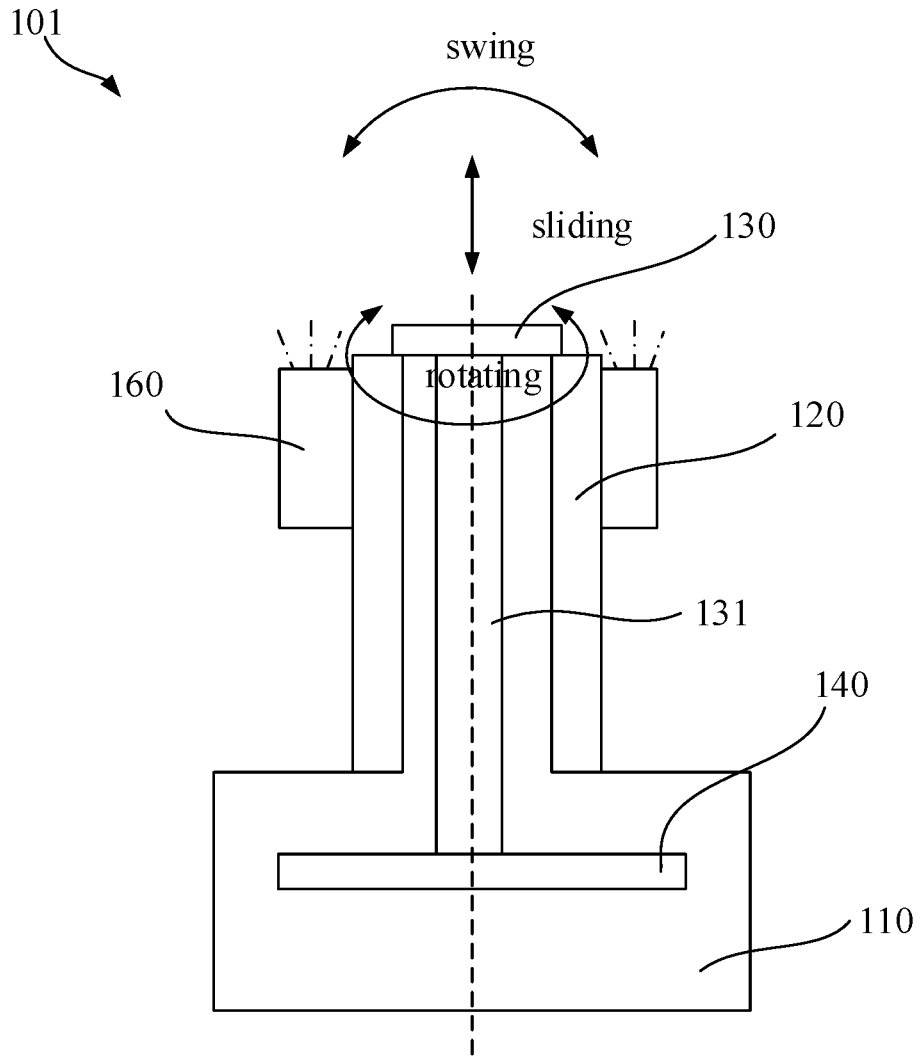
FIG. 2 is a schematic view of a shifter lever structure as shown in FIG. 1.

With reference to FIG. 1 and FIG. 2, a remote controller 100 in one embodiment of the present disclosure comprises a shifter lever structure 101, a controller 102, and a signal emission device 103. The shifter lever structure 101 comprises a base 110, a shifter lever 120, a press key 130 and a sensor 140.

The specific structure of the base 110 can be designed according to different requirements, for example, a structure commonly used by a person skilled in the art may be used, which will not be described herein in detail.

The press key 130 is movably connected to the base 110. Specifically, the press key 130 comprises a connecting rod 131 inserted into the shifter lever 120. The movable connection of the press key 130 can be rotation using the connecting rod 131 as a pivot shaft, sliding along the lengthwise direction of the connecting rod 131, swinging using the connecting rod 131 as a swinging shaft, and so on.

The shifter lever 120 is movably connected to the base 110, and is arranged surrounding the press key 130. The movable connection of the shifter lever 120 can be that the shifter lever 120 rotates around a rotating shaft, the shifter lever 120 slides along a pre-set direction, the shifter lever 120 swings along a pre-set direction, and so on.

The movement of the shifter lever 120 and the movement of the press key 130 can be the same, or can also be different. For example, while the shifter lever 120 rotates around the press key 130, the shifter lever 120 can use the connecting rod 131 of the press key 130 as a rotating shaft, and the press key 130 slides along the lengthwise direction of the connecting rod 131.

A sensor 140 is used for obtaining moving state information about the shifter lever 120 and the press key 130. The specific structure of the sensor 140 can be designed according to different requirements, for example, the designs as described in the following embodiments.

When the press key 130 is to rotate, the sensor 140 comprises a press key sensor 140*a* for sensing rotating state information about the press key 130. For example, the press key sensor 140*a* can be an angle sensor, an angular displacement sensor, an angular velocity sensor, an angular acceleration sensor, a torque sensor, and so on.

Correspondingly, the moving state information about the press key 130 can be the rotation angle of the press key 130, the rotation angle of the press key 130 relative to a null position, the rotation speed of the press key 130, the angular acceleration of the press key 130 during rotation, the magnitude of torsional force exerted on the press key 130 during rotation, and so on.

The press key 130 can reset automatically after rotation, i.e. when the press key 130 is released after the press key 130 rotates, the press key 130 can return to the original position automatically; or it is also possible that the press key 130 does not reset automatically after rotation, i.e. when the press key 130 is released after the press key 130 rotates, the press key 130 can remain at the current rotation position.

When the press key 130 is to slide along a pre-set direction, the sensor 140 comprises a press key sensor 140*a* for sensing sliding state information about the press key 130. For example, the press key sensor 140*a* can be a distance sensor, a linear displacement sensor, a linear velocity sensor, a linear acceleration sensor, a pressure sensor, and so on.

Correspondingly, the sliding state information about the press key 130 can be the sliding distance of the press key 130, the sliding displacement of the press key 130, the sliding velocity of the press key 130, the acceleration of the press key 130 during sliding, the magnitude of pressure exerted on the press key 130 during sliding, and so on.

The press key 130 can reset automatically after sliding, i.e. when the press key 130 is released after the press key 130 slides, the press key 130 can reset to the original position automatically. It is also possible that the press key 130 does not reset automatically after sliding, i.e. when the press key 130 is released after the press key 130 slides, the press key 130 can remain at the current sliding position.

When the press key 130 is to swing along a pre-set direction, the sensor 140 comprises a press key sensor 140*a* for sensing swinging state information about the press key 130. For example, the press key sensor 140*a* can be an angle sensor, an angular displacement sensor, an angular velocity sensor, an angular acceleration sensor, a torque sensor, and so on.

Correspondingly, the swinging state information about the press key 130 can be the swinging angle of the press key 130, the swinging angle of the press key 130 relative to a null position, the swinging speed of the press key 130, the angular acceleration of the press key 130 during swinging, and the magnitude of torsional force exerted on the press key 130 during swinging.

The press key 130 can reset automatically after swinging, i.e. when the press key 130 is released after the press key 130 swings, the press key 130 can reset to the original position automatically. Alternatively, it is also possible that the press key 130 does not reset automatically after swinging, i.e. when the press key 130 is released after the press key 130 swings, the press key 130 can remain at the current swinging position.

When the shifter lever 120 rotates around a rotating shaft, the sensor 140 comprises a shifter lever sensor 140*b* for sensing rotating state information about the shifter lever 120. For example, the shifter lever sensor 140*b* can be an angle sensor, an angular displacement sensor, an angular velocity sensor, an angular acceleration sensor, a torque sensor, and so on.

Correspondingly, the moving state information about the shifter lever 120 can be the rotation angle of the shifter lever 120, the rotation angle of the shifter lever 120 relative to a null position, the rotation speed of the shifter lever 120, the angular acceleration of the shifter lever 120 during rotation, the magnitude of torsional force exerted on the shifter lever 120 during rotation, and so on.

The shifter lever 120 can reset automatically after rotation, i.e. when the shifter lever 120 is released after the shifter lever 120 rotates, the shifter lever 120 can return to the original position automatically. Alternatively, it is also possible that the shifter lever 120 does not reset automatically after rotation, i.e. when the shifter lever 120 is released after the shifter lever 120 rotates, the shifter lever 120 can remain at the current rotation position.

When the shifter lever 120 is to slide along a pre-set direction, the sensor 140 comprises a shifter lever sensor 140*b* for sensing sliding state information about the shifter lever 120. For example, the shifter lever sensor 140*b* can be a distance sensor, a linear displacement sensor, a linear velocity sensor, a linear acceleration sensor, a pressure sensor, and so on.

Correspondingly, the sliding state information about the shifter lever 120 can be the sliding distance of the shifter lever 120, the sliding displacement of the shifter lever 120, the sliding velocity of the shifter lever 120, the acceleration of the shifter lever 120 during sliding, the magnitude of pressure exerted on the shifter lever 120 during sliding, and so on.

The shifter lever 120 can reset automatically after sliding, i.e. when the shifter lever 120 is released after the shifter lever 120 slides, the shifter lever 120 can reset to the original position automatically. Alternatively, the shifter lever 120 does not reset automatically after sliding, i.e. when the shifter lever 120 is released after the shifter lever 120 slides, the shifter lever 120 can remain at the current sliding position.

When the shifter lever 120 is to swing along a pre-set direction, the sensor 140 comprises a shifter lever sensor 140*b* for sensing swinging state information about the shifter lever 120. For example, the shifter lever sensor 140*b* can be an angle sensor, an angular displacement sensor, an angular velocity sensor, an angular acceleration sensor, a torque sensor, and so on.

Correspondingly, the swinging state information about the shifter lever 120 can be the swinging angle of the shifter lever 120, the swinging angle of the shifter lever 120 relative to a null position, the swinging speed of the shifter lever 120, the angular acceleration of the shifter lever 120 during swinging, and the magnitude of torsional force exerted on the shifter lever 120 during swinging.

The shifter lever 120 can reset automatically after swinging, i.e. when the shifter lever 120 is released after the shifter lever 120 swings, the shifter lever 120 can reset to the original position automatically. Alternatively, it is also possible that the shifter lever 120 does not reset automatically after swinging, i.e. when the shifter lever 120 is released after the shifter lever 120 swings, the shifter lever 120 can remain at the current swinging position.

The shifter lever structure 101 further comprises a light guiding part 160 arranged surrounding the shifter lever 120. The light guiding part 160 is used for leading out light rays from the light-emitting element, and the light rays are emitted around the periphery of the shifter lever 120 so as to perform an indicative function. The light rays led out by the light guiding part 160 can be used as an operating indication of the press key 130 or the shifter lever 120, or a feedback indication of a control signal of the shifter lever structure 101, and so on.

The shifter lever structure 101 further comprises a light-emitting element arranged corresponding to the light guiding part 160, and the light-emitting element shows an indicative message via light colours and/or light-emitting states. For example, the light-emitting element can be an LED with three primary colours, and shows different indicative messages using different colours. Alternatively, the light-emitting element may display different light-emitting states, such as flickering, constantly lit, and long and short flashes to represent different indicative messages.

The indicative messages are used for indicating at least one of: the operating state of the press key 130, the operating state of the shifter lever 120, and the state of an object remotely controlled. For example, when the press key 130 is operated, the light-emitting element begins to flicker. Alternatively, when the shifter lever 120 is operated, the light-emitting element is constantly lit. Alternatively, when the shifter lever structure 101 is operated to control a UAV to return and when the UAV begins to return, the light-emitting element begins to flicker until the UAV has lands, when the light-emitting element stops flickering.

The controller 102 is electrically connected to the sensor 140. The specific structure of the controller 102 can be designed according to different requirements, for example, the controller 102 can be a circuit board provided with a control circuit, or a control chip, and so on.

The signal emission device 103 is electrically connected to the controller 102. The sensor 140 transmits the moving state information to the controller 102, and the controller 102 emits a corresponding control signal via the signal emission device 103.

The specific structure of the signal emission device 103 can be designed according to different requirements, for example, the signal emission device 103 can be an antenna, a high definition image transmission device, and so on.

Based on the above-mentioned remote controller 100, the present disclosure further provides control methods.

One control method of the embodiments of the present disclosure adopts a remote controller 100 as described above, and the method comprises the steps of: operating the shifter lever structure 101, and emitting a control signal by the controller 102 via the signal emission device 103.

The step of operating the shifter lever structure 101 can be rotating the shifter lever 120, swinging the shifter lever 120, pressing the shifter lever 120, pressing the press key 130, rotating the press key 130, swinging the press key 130, and so on.

The control signal can be used for adjusting information/parameters about a mobile device, an imaging device, a gimbal platform, a sensor unit, a base station, and so on.

Specifically, the information about the mobile device can be the attitude of a moving object, the moving mode of the moving object, the moving speed of the moving object, the moving height of the moving object, the moving direction of the moving object, and so on.

The mobile device can be an aerial mobile device, an on-water mobile device, an in-water mobile device, and a ground mobile device. The aerial mobile device can be a UAV, an aerial mobile base station, and so on. The ground mobile device can be a remote control tank, a remote control toy, and so on. The in-water mobile device can be a toy submarine, and so on. The on-water mobile device can be a remote control boat, and so on.

Information about the imaging device can be the working mode of the imaging device, the shutter time of the imaging device, the aperture size of the imaging device, the photosensitivity of the imaging device, a preview image from the imaging device, and so on. The imaging device can be a camera, a webcam, a video camera, and so on.

Information about the gimbal platform comprises at least one of: the attitude of the gimbal platform, and the control mode of the gimbal platform. The gimbal platform can be a hand-held gimbal platform, a vehicle-mounted gimbal platform, a gimbal platform carried by a UAV, and so on.

Information about the sensor 140 comprises at least one of: the operating state of the sensor unit, and working parameters of the sensor unit. The sensor unit can be an altimeter, a distance sensor, and so on.

Information about the base station comprises at least one of: the operating state of the base station, and the control mode of the base station. The base station can be a UAV ground base station, a UAV aerial base station, and so on.

Figure 3:
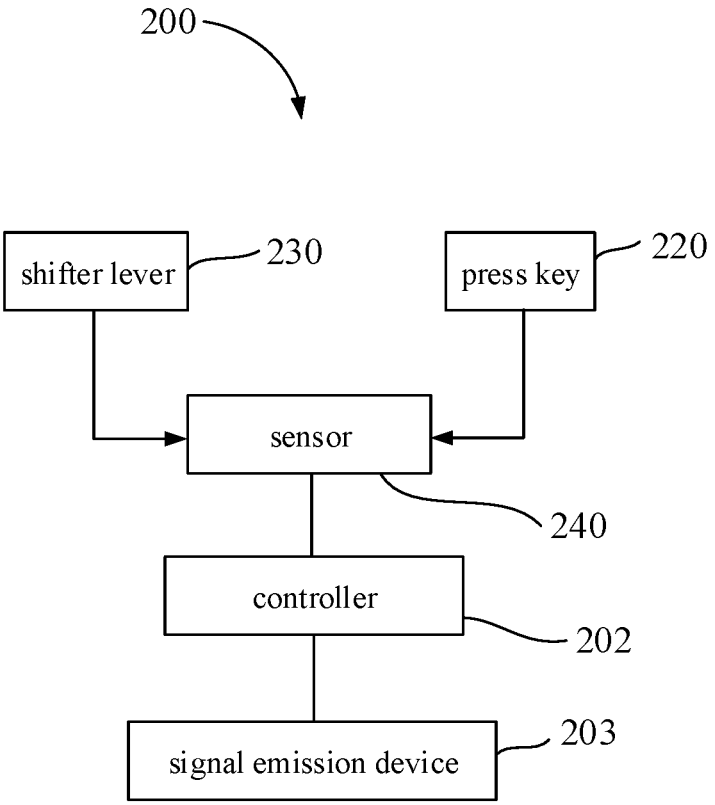
FIG. 3 is a principle diagram of a remote controller in another embodiment of the present disclosure.
Figure 4:
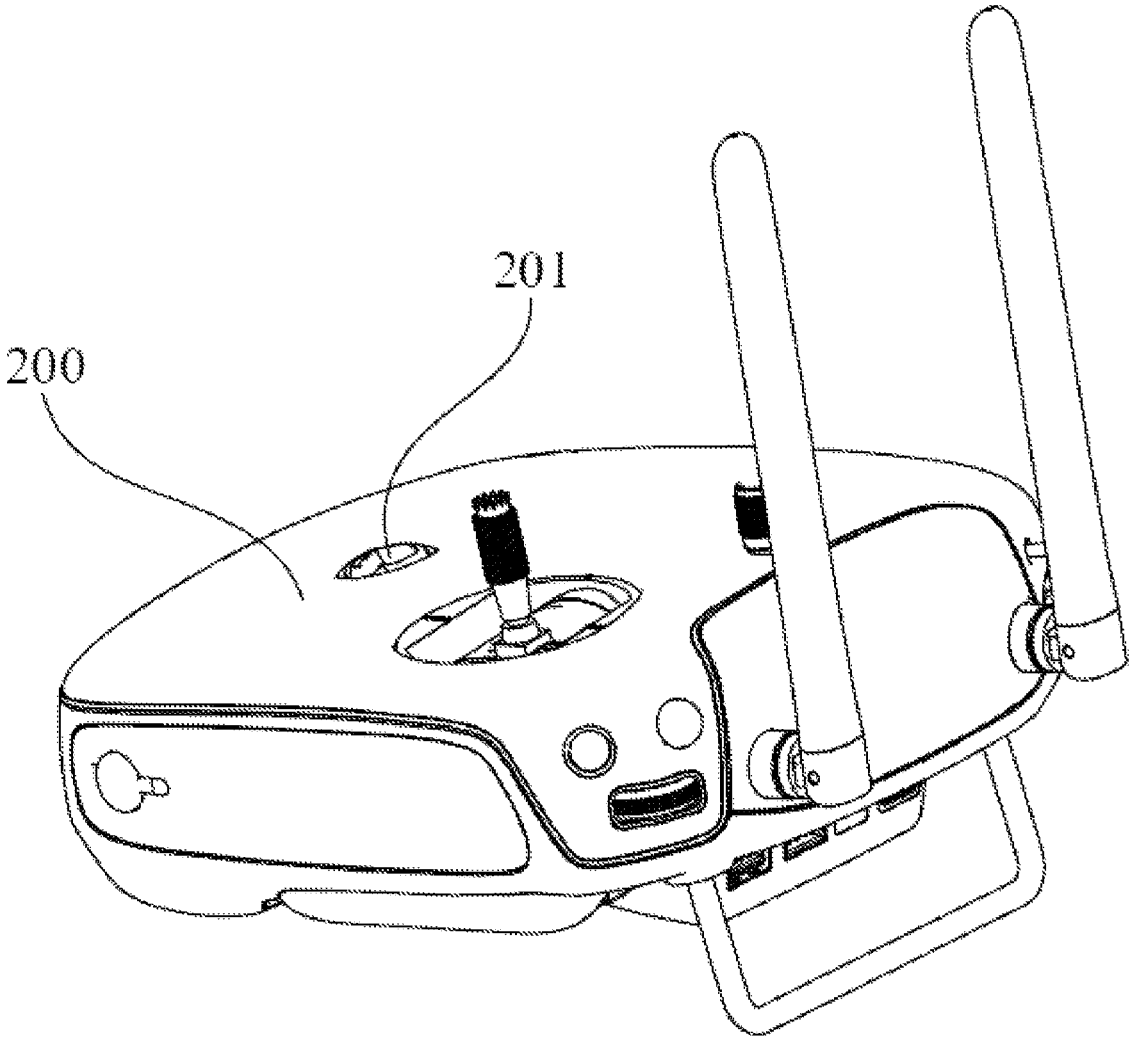
FIG. 4 is a perspective view of the remote controller as shown in FIG. 3.
Figure 5:
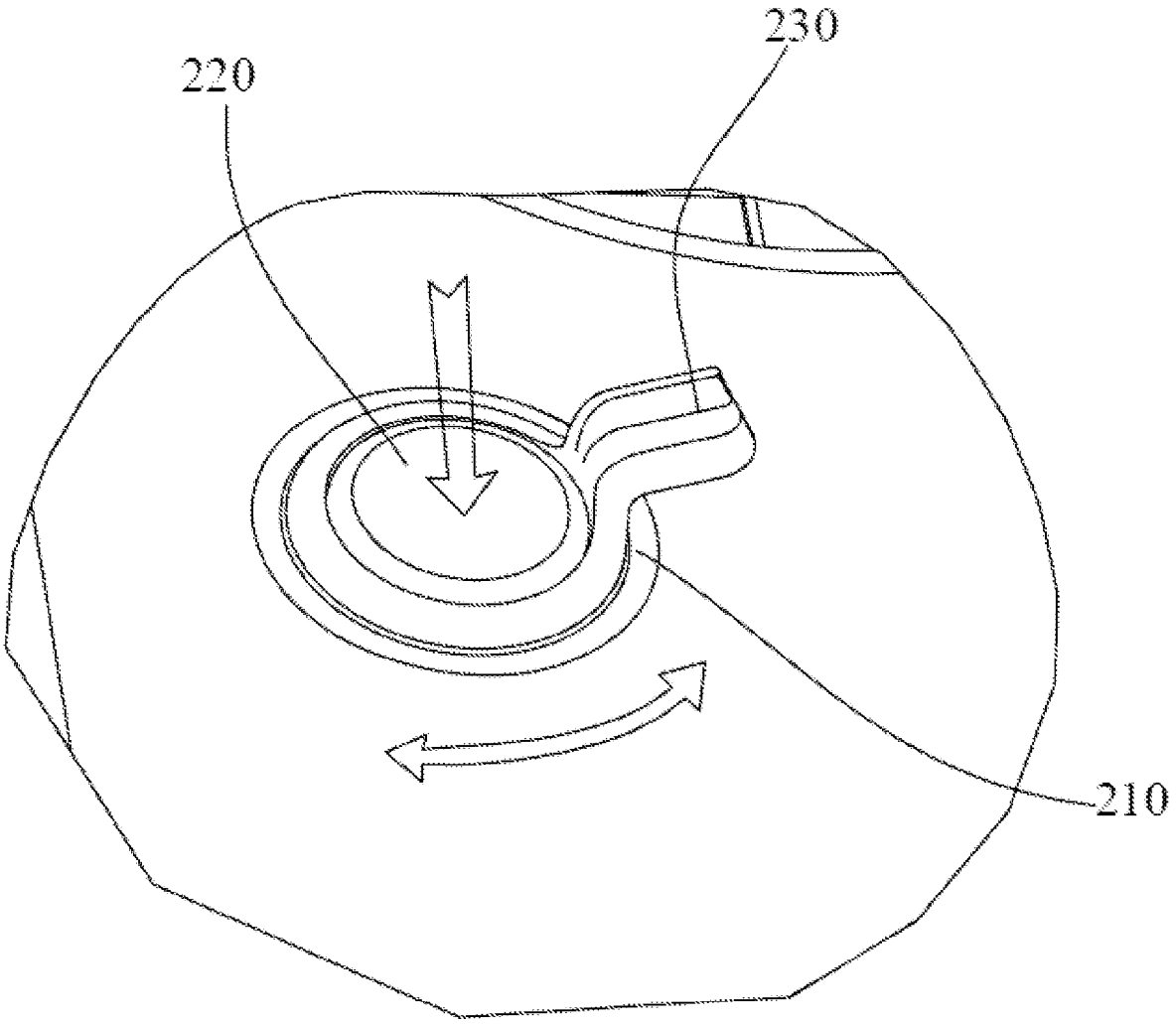
FIG. 5 is a partial schematic view of the remote controller as shown in FIG. 4.

With reference to FIG. 3, FIG. 4 and FIG. 5, a remote controller 200 in another embodiment of the present disclosure comprises a shifter lever structure 201, a controller 202, and a signal emission device 203. The shifter lever structure 201 comprises a base 210, a press key 220, a shifter lever 230 and a sensor 240.

Figure 6:
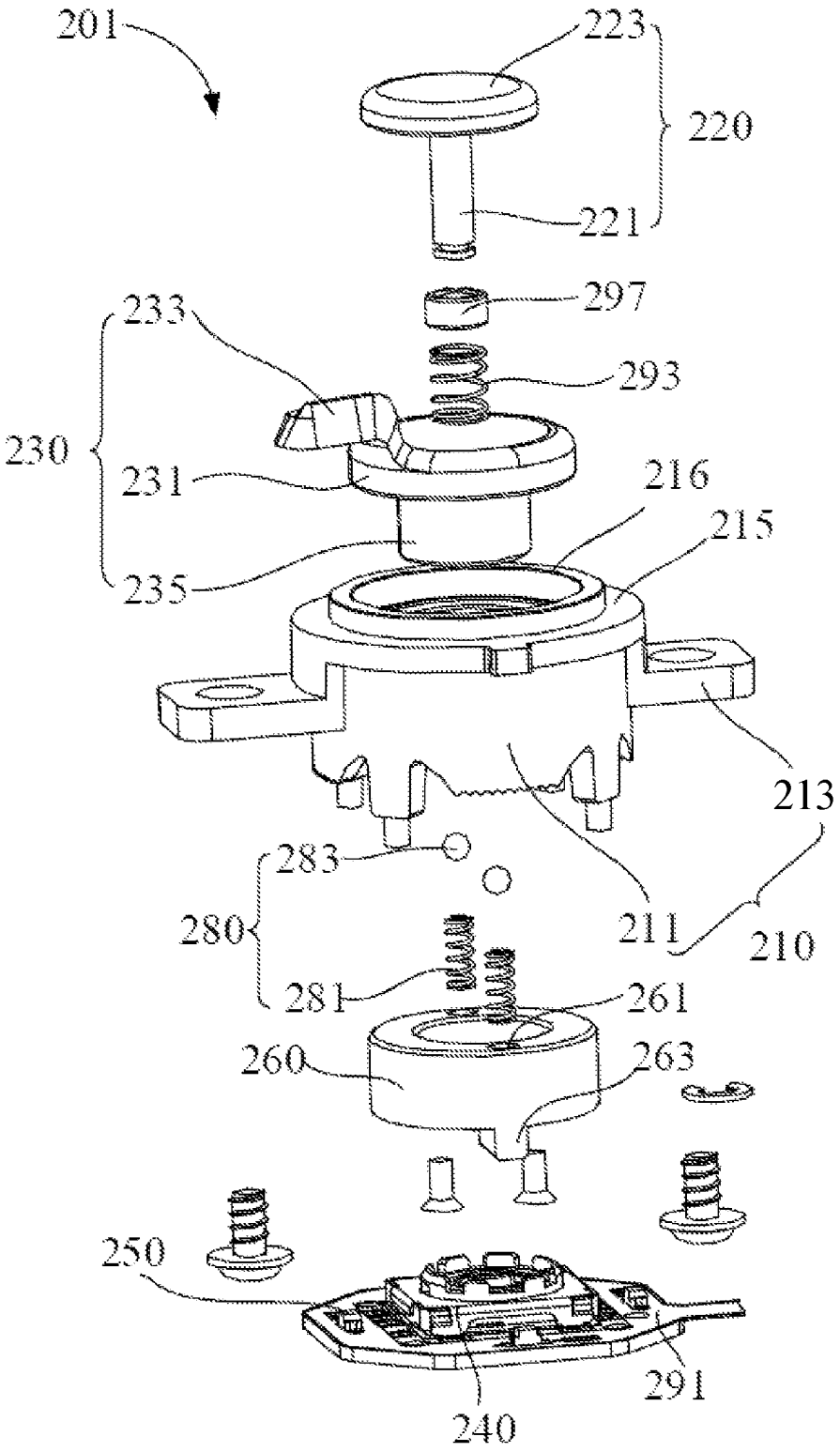
FIG. 6 is an exploded view of the shifter lever structure as shown in FIG. 4.
Figure 7:
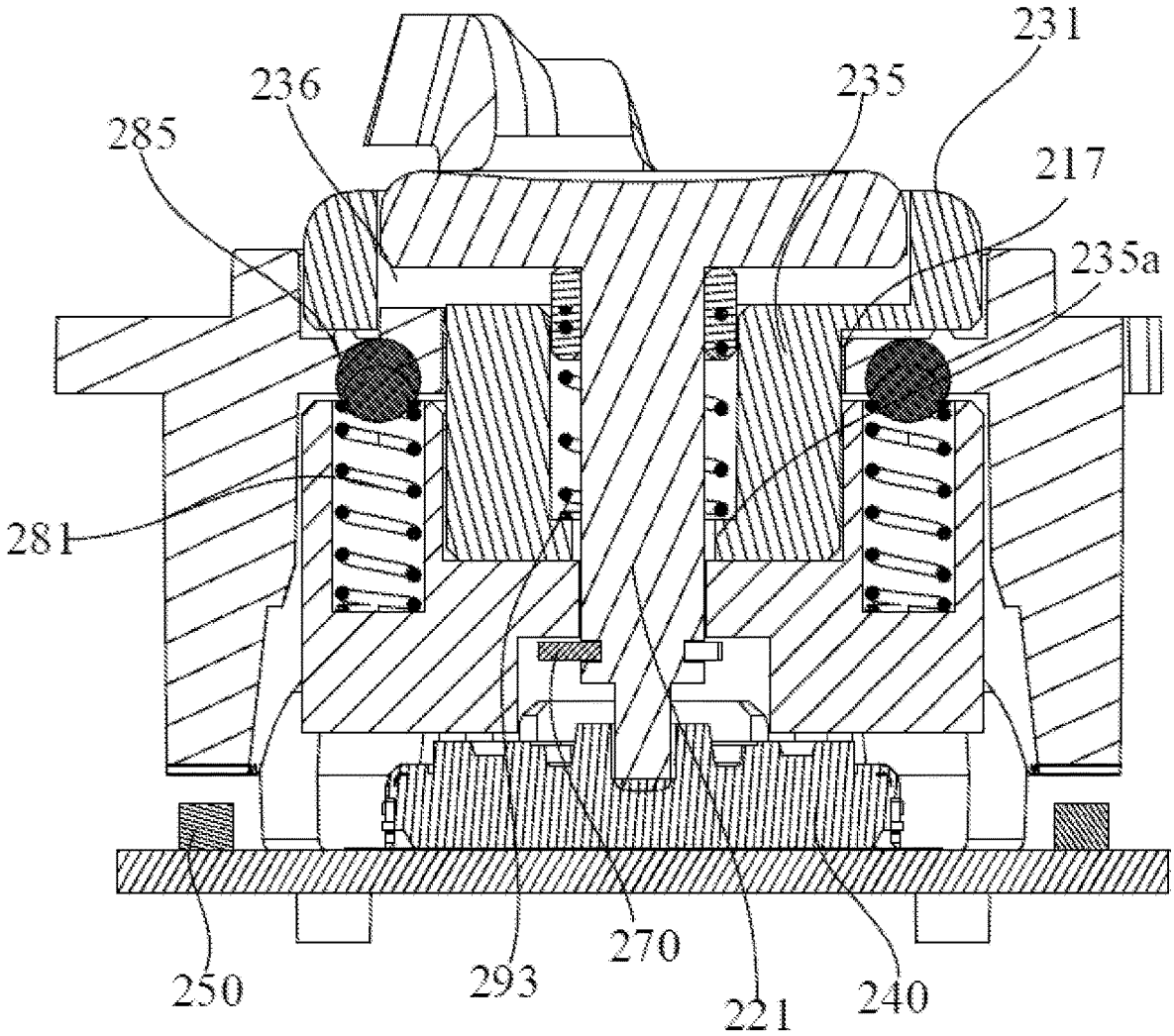
FIG. 7 is an axial sectional view of the shifter lever structure as shown in FIG. 4.
Figure 8:
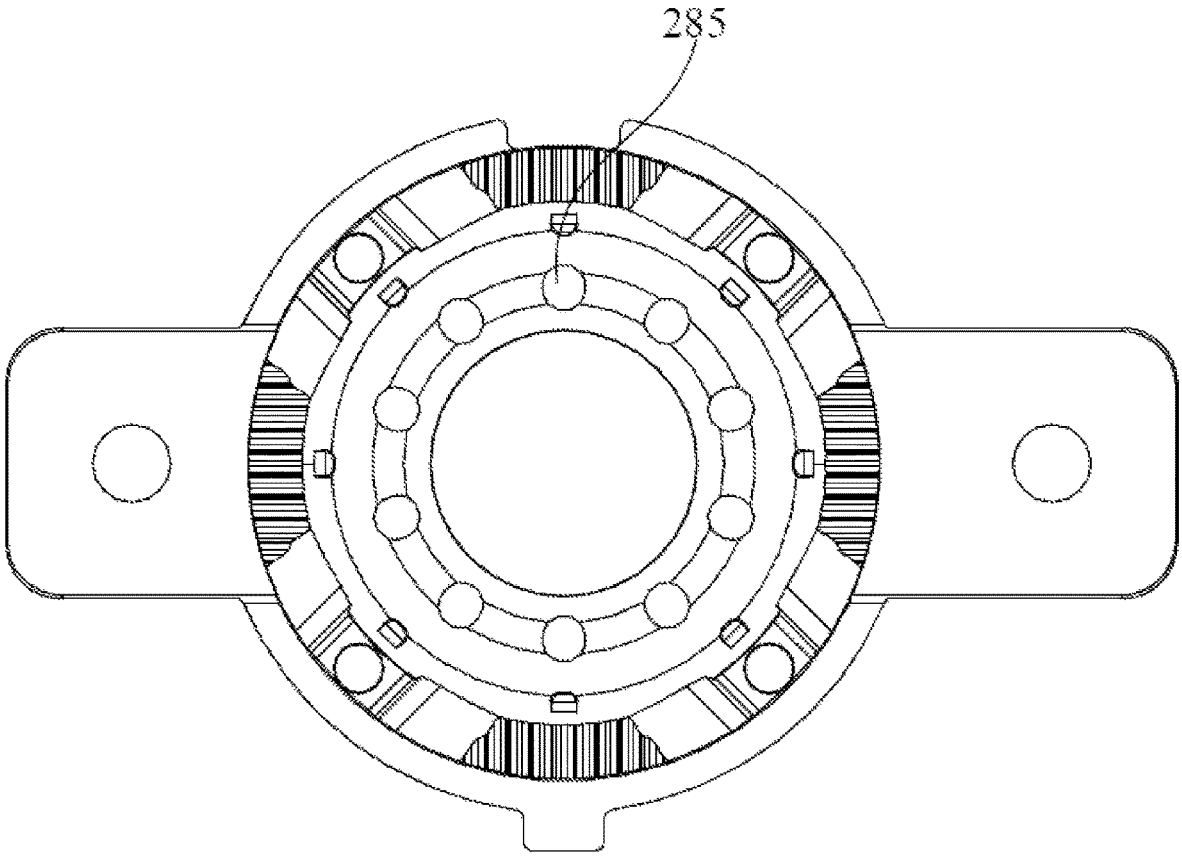
FIG. 8 is a bottom view of a base of the shifter lever structure as shown in FIG. 6.

With reference to FIG. 6, FIG. 7 and FIG. 8, the specific structure of the base 210 can be designed according to different requirements, for example, in the embodiment illustrated, the base 210 comprises a mounting barrel 211 and a plurality of mounting lugs 213, and the plurality of mounting lugs 213 are arranged on the outer wall of the mounting barrel 211 and are spaced apart from each other.

Furthermore, the base 210 comprises a light guiding part 215 surrounding the periphery of the shifter lever 230. Specifically, in the embodiment illustrated, the mounting barrel 211 is made of a transparent material, and the circumferential wall of the mounting barrel 211 is the light guiding part 215.

Furthermore, a light-emitting element 250 arranged corresponding to the light guiding part 215 is further comprised. Specifically, the light-emitting element 250 is arranged corresponding to an end face at an end of the mounting barrel 211, and the light rays are led out to an end face at the other end of the mounting barrel 211 via the circumferential wall of the mounting barrel 211.

The light guiding part 215 is used for leading out light rays from the light-emitting element 250, and the light rays are emitted around the periphery of the shifter lever 230 so as to perform an indicative function. The light rays led out by the light guiding part 215 can be used as an operating indication of the press key 220 or the shifter lever 230, or a feedback indication of a control signal of the shifter lever structure 201, and so on.

The light-emitting element 250 shows an indicative message via light colours and/or light-emitting states. For example, the light-emitting element 250 can be an LED with three primary colours, and shows different indicative messages using different colours. Alternatively, the light-emitting element 250 display different light-emitting states, such as flickering, constantly lit, and long and short flashes to represent different indicative messages.

The indicative messages are used for indicating at least one of: the operating state of the press key 220, the operating state of the shifter lever 230, and the state of an object remotely controlled. For example, when the press key 220 is being operated, the light-emitting element 250 begins to flicker. Alternatively, when the shifter lever 230 is operated, the light-emitting element 250 is constantly lit. Alternatively, when the shifter lever structure 201 is operated to control a UAV to return and when the UAV begins to return, the light-emitting element 250 begins to flicker until the UAV lands, when the light-emitting element 250 stops the flickering.

The press key 220 can slide relative to the base 210. Specifically, in the embodiment illustrated, the press key 220 comprises a connecting rod 221, and the connecting rod 221 is inserted into the base 210 and can slide into the base 210 along the lengthwise direction of the connecting rod 221.

Furthermore, the press key 220 further comprises a button 223 arranged at an end of the connecting rod 221, and the connecting rod 221 may be pressed via the button 223.

The shifter lever 230 is rotatably connected to the base 210, and can rotate around the press key 220. In some embodiments, the sliding direction of the press key 220 approximately coincides with the lengthwise direction of the shifter lever 230, e.g., the sliding direction of the press key 220 is approximately parallel to the lengthwise direction of the shifter lever 230. For example, in the embodiment illustrated, the connecting rod 221 passes through the shifter lever 230, and can slide relative to the shifter lever 230, and the shifter lever 230 uses the connecting rod 221 as a rotating shaft.

The specific structure of the shifter lever 230 can be designed according to different requirements, for example, in the embodiment illustrated, the shifter lever 230 comprises a rotating part 231 and a shifting part 233 connected to the rotating part 231, and the rotating part 231 is driven to rotate around the connecting rod 221 of the press key 220 via the shifting part 233.

Furthermore, the top surface of the rotating part 231 is provided with an accommodating groove 236 for accommodating the button 223, the button 223 can slide in the accommodating groove 236, and the connecting rod 221 passes through the bottom part of the accommodating groove 236.

Furthermore, the shifter lever 230 further comprises a rotary barrel 235, one end of the rotary barrel 235 is an opening end, the other end thereof is provided with a through hole **235*a* for the connecting rod 221 to pass through, and the opening end is fixedly connected to the rotating part 231**.

Specifically, the rotary barrel 235 passes through the mounting barrel 211 of the base 210 and can rotate in the mounting barrel 211 of the base 210.

A sensor 240 is used for obtaining rotating state information about the shifter lever 230 and sliding state information about the press key 220.

The specific structure of the sensor 240 can be designed according to different requirements, for example, when the sensor 240 is used for obtaining the rotating state information about the shifter lever 230, the sensor 240 comprises at least one of: an angle sensor, an angular displacement sensor, an angular velocity sensor, an angular acceleration sensor, and a torque sensor.

Correspondingly, the rotating state information can comprise at least one of: the rotation angle of the shifter lever 230, the rotation angle of the shifter lever 230 relative to a null position, the rotation speed of the shifter lever 230, the angular acceleration of the shifter lever 230 during rotation, and the magnitude of torsional force exerted on the shifter lever 230 during rotation.

Specifically, in the embodiment illustrated, the shifter lever 230 and the sensor 240 constitute a gear switch, that is, the sensor 240 comprises a multi-gear angular displacement sensor.

When the shifter lever 230 is being operated, the shifter lever 230 can reset automatically, i.e. when the shifter lever 230 is released after the shifter lever 230 rotates, the shifter lever 230 can return to the original position automatically. Alternatively, it is possible that the shifter lever 230 does not reset automatically, i.e. when the shifter lever 230 is released after the shifter lever 230 rotates, the shifter lever 230 can remain at the current rotation position.

When the sensor 240 is used for obtaining the sliding state information about the press key 220, the sensor 240 can comprise at least one of: a distance sensor, a linear displacement sensor, a linear velocity sensor, a linear acceleration sensor, and a pressure sensor.

Correspondingly, the sliding state information can comprise at least one of: the sliding distance of the press key 220, the sliding displacement of the press key 220, the sliding velocity of the press key 220, the acceleration of the press key 220 during sliding, and the magnitude of pressure exerted on the press key 220 during sliding.

Specifically, in the embodiment illustrated, the press key 220 and the sensor 240 constitute a press switch, that is, the sensor 240 comprises a switch type pressure sensor.

When the press key 220 is being operated, the press key 220 can reset automatically, i.e. when the press key 220 is released after the press key 220 slides, the press key 220 can reset to the original position automatically. Alternatively, it is possible that the press key 220 does not reset automatically, i.e. when the press key 220 is released after the press key 220 slides, the press key 220 can remain at the current sliding position.

Furthermore, the shifter lever structure 201 further comprises a rotation trigger 260, the rotation trigger 260 is fixedly connected to the end, which is far away from the rotating part 231, of the rotary barrel 235 of the shifter lever 230, the rotation trigger 260 is arranged corresponding to the sensor 240, and the rotating state information about the shifter lever 230 is obtained by sensing the rotating state of the rotation trigger 260.

The specific structure of the rotation trigger 260 can be designed according to different requirements, for example, in the embodiment illustrated, the rotation trigger 260 is a bush which mates with the rotary barrel 235, and the end part of the rotary barrel 235 provided with a through hole 235*a* is fixed in the bush so as to drive the bush to rotate.

Furthermore, a locking member 270 is further comprised, the end of the connecting rod 221 far away from the button 223 is connected to the locking member 270 after passing through the rotation trigger 260 so as to prevent the connecting rod 221 from falling off the rotation trigger 260.

Furthermore, the shifter lever structure 201 further comprises a rotation damping mechanism 280 for providing damping during rotation of the shifter lever structure 201, and the rotation damping mechanism 280 is connected to the rotation trigger 260.

The specific structure of the rotation damping mechanism 280 can be designed according to different requirements, for example, in the embodiment illustrated, the rotation damping mechanism 280 comprises an elastic reset member 281, a roller ball 283 and a plurality of limiting parts 285. The plurality of limiting parts 285 are arranged on the base 210 and are spaced apart from each other. The rotation trigger 260 is provided with an accommodating groove 261 for accommodating the elastic reset member 281 and the roller ball 283, the roller ball 283 abuts against the elastic reset member 281, and can selectively fit with one limiting part 285 thereof so as to provide rotation resistance.

Specifically, the accommodating groove 261 may be arranged on an end face at an end of the bush, and extends along the axial direction of the bush.

Furthermore, an end face at the other end of the bush is provided with a trigger boss 263, and the sensor 240 obtains the rotating state information about the shifter lever 230 by sensing a rotating turntable of the trigger boss 263.

In other embodiments, the rotation damping mechanism 280 may comprise an elastic snapping strip, and a plurality of limiting parts 285 which are spaced apart from each other. One of the base 210 and the rotation trigger 260 is provided with an elastic snapping strip, the other one is provided with a plurality of limiting parts 285, and the elastic snapping strip can selectively abut against one limiting part 285 thereof so as to provide rotation resistance.

The specific structure of the limiting part 285 can be designed according to different requirements, for example, the limiting part 285 can be a hemispherical groove, continuous serration, a V-shaped boss, and so on.

Furthermore, the shifter lever structure 201 further comprises a circuit board 291 for carrying the sensor 240; the rotation trigger 260 and the sensor 240 are both accommodated in the mounting barrel 211 of the base 210; and the mounting barrel 211 is fixedly connected to the circuit board 291 so as to form a sealed cavity.

Specifically, the light-emitting element 250 and the sensor 240 are both fixed on the circuit board 291, and are electrically connected to the circuit board 291.

Furthermore, an end face at the end, which is far away from the circuit board 291, of the mounting barrel 211 of the base 210 is provided with an accommodating part 216, the bottom part of the accommodating part 216 is provided with a penetration hole 217 in communication with an inner cavity of the mounting barrel 211, the rotating part 231 of the shifter lever 230 is rotatably accommodated in the accommodating part 216, and the rotary barrel 235 passes through the penetration hole 217.

Furthermore, the shifter lever structure 201 further comprises a sliding reset member 293 for providing an elastic restoring force to the connecting rod 221.

The connecting method of the sliding reset member 293 can be designed according to different requirements, for example, in the embodiment illustrated, the sliding reset member 293 is sheathed on the connecting rod 221, and is accommodated in the rotary barrel 235 of the shifter lever 230. The sliding reset member 293 can be a compression spring, an extension spring, an elastic piece, an elastic rubber bush, and so on.

Furthermore, the shifter lever structure 201 further comprises a shaft sleeve 297, the shaft sleeve 297 is fixedly sheathed on the connecting rod 221, and two ends of the sliding reset member 293 respectively abut against the shaft sleeve 297 and the end of the rotary barrel 235 which is provided with a through hole 235*a*.

Specifically, two ends of the sliding reset member 293 may respectively abut against the button 223 and the end of the rotary barrel 235 which is provided with a through hole 235*a*.

It shall be explained that the rotation trigger 260 can also be omitted, and in this case, an opening end of the rotary barrel 235 far away from the rotating part 231 is arranged corresponding to the sensor 240, and the rotating state information about the shifter lever 230 is obtained by sensing the rotating state of the rotary barrel 235.

The controller 202 is electrically connected to the sensor 240. The specific structure of the controller 202 can be designed according to different requirements, for example, the controller 202 can be a circuit board 291 provided with a control circuit, or a control chip, and so on.

The signal emission device 203 is electrically connected to the controller 202. The sensor 240 transmits the rotating state information about the shifter lever 230 and the sliding state information about the press key 220 to the controller 202, and the controller 202 emits a corresponding control signal via the signal emission device 203.

The specific structure of the signal emission device 203 can be designed according to different requirements, for example, the signal emission device 203 can be an antenna, a high definition image transmission device, and so on.

A shifter lever of the above-mentioned shifter lever structure, which comprises a press key and is arranged surrounding the press key, facilitates operating the press key or the shifter lever selectively, for example, the shifter lever can rotate around a rotating shaft or the press key slides along a pre-set direction, and so on; by obtaining the rotating state information about the shifter lever and the sliding state information about the press key via the sensor, the above described structure facilitates operating the shifter lever structure via one moving mode or a combination of multiple operating modes so as to achieve the purpose of performing multiple operating functions, without the need to arrange a plurality of shifter lever structures or other control structures. Therefore, it is relatively convenient to control the multiple functions via the above-mentioned shifter lever structure.

The foregoing is merely illustrative of the embodiments of the disclosure but not intended to limit the scope of the disclosure. Any equivalent modifications to a structure or process flow, which are made without departing from the specification and the drawings of the disclosure, and a direct or indirect application in other relevant technical fields, shall also fall into the scope of the disclosure.

What is claimed is:

1. A remote controller comprising:

a shifter lever structure comprising:

a base;

a press key movably connected to the base, a shifter lever arranged surrounding the press key and movably connected to the base, the press key is linearly slidable relative to the shifter lever; and a combined sensor unit coupled to the press key and the shifter lever, the combined sensor unit being configured to obtain moving state information about the press key and the shifter lever, and the combined sensor unit comprising at least one of an angle sensor, an angular displacement sensor, an angular velocity sensor, an angular acceleration sensor, a torque sensor, a distance sensor, a linear displacement sensor, a linear velocity sensor, a linear acceleration sensor, or a pressure sensor;

a controller electrically coupled to the combined sensor unit; and a circuit board, the combined sensor unit and controller are mounted to the circuit board;

a signal emission device electrically coupled to the controller, wherein the controller is configured to receive the moving state information from the combined sensor unit and emit a control signal corresponding to the moving state information via the signal emission device.

2. The remote controller according to claim 1, wherein the press key and the shifter lever are configured to perform at least one of:

the press key sliding relative to the base; or the shifter lever rotating around the press key.

3. The remote controller according to claim 2, wherein a sliding direction of the press key approximately coincides with a lengthwise direction of the shifter lever.

4. The remote controller according to claim 2, wherein the press key comprises a connecting rod inserted in the base and configured to slide in the base along a lengthwise direction of the connecting rod.

5. The remote controller according to claim 4, wherein:

the connecting rod passes through the shifter lever and is configured to slide relative to the shifter lever; and the shifter lever is configured to rotate around the connecting rod.

6. The remote controller according to claim 4, wherein the press key further comprises a button arranged at one end of the connecting rod.

7. The remote controller according to claim 6, wherein the shifter lever comprises a rotating part and a shifting part connected to the rotating part, and the shifting part is configured to drive the rotating part to rotate around the connecting rod.

8. The remote controller according to claim 7, wherein:

a top surface of the rotating part includes an accommodating groove for accommodating the button;

the button is configured to slide in the accommodating groove; and the connecting rod passes through a bottom part of the accommodating groove.

9. The remote controller according to claim 8, wherein the shifter lever further comprises a rotary barrel, a first end of the rotary barrel being an opening end fixedly connected to the rotating part, and a second end of the rotary barrel including a through hole for the connecting rod to pass through.

10. The remote controller according to claim 9, wherein the shifter lever structure further comprises:

a rotation trigger fixedly connected to the second end of the rotary barrel and arranged corresponding to the combined sensor unit;

wherein the combined sensor unit is further configured to obtain rotating state information about the shifter lever by sensing a rotating state of the rotation trigger.

11. The remote controller according to claim 10, wherein:

the rotation trigger includes a bush mating with the rotary barrel; and the second end of the rotary barrel is fixed in the bush and is configured to drive the bush to rotate.

12. The remote controller according to claim 10, wherein the shifter lever structure further comprises:

a rotation damping mechanism for providing damping during rotation of the shifter lever structure.

13. The remote controller according to claim 12, wherein:

the rotation damping mechanism comprises:

a plurality of limiting parts arranged on the base and being spaced apart from each other;

an elastic reset member accommodated in an accommodating groove in the rotation trigger; and a roller ball accommodated in the accommodating groove in the rotation trigger and abutting against the elastic reset member, the roller ball being configured to selectively fit with one of the limiting parts to provide a rotation resistance, or the rotation damping mechanism comprises:

a plurality of limiting parts spaced apart from each other and arranged on one of the base and the rotation trigger; and an elastic snapping strip arranged on another one of the base and the rotation trigger and configured to selectively abut against one of the limiting parts to provide the rotation resistance.

14. The remote controller according to claim 10, wherein:

the base comprises a mounting barrel for accommodating the rotation trigger and the combined sensor unit, the mounting barrel being fixedly connected to the circuit board to form a sealed cavity.

15. The remote controller according to claim 14, wherein:

an end face at an end of the mounting barrel far away from the circuit board includes an accommodating part, a bottom part of the accommodating part including a penetration hole in communication with an inner cavity of the mounting barrel;

the rotating part is rotatably accommodated in the accommodating part; and the rotary barrel passes through the penetration hole.

16. The remote controller according to claim 10, wherein the shifter lever structure further comprises:

a locking member, an end of the connecting rod far away from the button being connected to the locking member to prevent the connecting rod from falling off the rotation trigger.

17. The remote controller according to claim 4, wherein the shifter lever structure further comprises:

a sliding reset member providing an elastic restoring force to the connecting rod.

18. The remote controller according to claim 1, wherein:

the shifter lever is configured to automatically return to an original position or remain at a current rotation position when the shifter lever is released after moving; or the press key is configured to automatically reset to an original position or remain at a current sliding position when the press key is released after moving.

19. The remote controller according to claim 1, wherein the base comprises a light guiding part surrounding a peripheral of the shifter lever.

20. The remote controller according to claim 19, wherein the shifter lever structure further comprises:

a light-emitting element arranged corresponding to the light guiding part.

* * * * *